US010010149B2

(12) United States Patent
Yamashita et al.

(10) Patent No.: US 10,010,149 B2
(45) Date of Patent: Jul. 3, 2018

(54) DRYER

(71) Applicant: Nidec Corporation, Kyoto (JP)

(72) Inventors: Takamasa Yamashita, Kyoto (JP); Yoshihiro Uchitani, Kyoto (JP); Shingo Yoshino, Kyoto (JP); Shigekatsu Matsuda, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 357 days.

(21) Appl. No.: 15/059,419

(22) Filed: Mar. 3, 2016

(65) Prior Publication Data

US 2016/0273831 A1 Sep. 22, 2016

(30) Foreign Application Priority Data

Mar. 17, 2015 (JP) ..... 2015-052810

(51) Int. Cl.
*A45D 20/10* (2006.01)
*A45D 20/12* (2006.01)

(52) U.S. Cl.
CPC ..... *A45D 20/12* (2013.01)

(58) Field of Classification Search
CPC ..... A45D 20/12
See application file for complete search history.

(56) References Cited

U.S. PATENT DOCUMENTS 4,972,065 A * 11/1990 Ohlsen ..... A45D 20/12 34/97
5,701,681 A * 12/1997 Wonka ..... A45D 20/12 34/96
9,693,616 B2 * 7/2017 Sakuma ..... A45D 20/12
2016/0213123 A1 * 7/2016 Sakuma ..... A45D 20/12

FOREIGN PATENT DOCUMENTS

JP 10-257918 A 9/1998

* cited by examiner

*Primary Examiner* — Jessica Yuen
(74) *Attorney, Agent, or Firm* — Keating & Bennett, LLP

(57) ABSTRACT

A dryer includes a body portion arranged to hold a motor, a first tubular portion arranged to at least partially cover an outer circumferential portion of the body portion, and a second tubular portion arranged axially behind the first tubular portion, and arranged to at least partially cover the outer circumferential portion of the body portion. An outer circumferential joining portion included in the body portion is held between an axial rear edge portion of the first tubular portion and an axial front edge portion of the second tubular portion.

13 Claims, 8 Drawing Sheets

DRYER

BACKGROUND OF THE INVENTION

1. Field of the Invention

The present invention relates to a dryer.

2. Description of the Related Art

Driers designed to dry or heat objects by blowing a hot wind are known. Such a known dryer typically includes a substantially tubular housing, a fan arranged in a rear portion of an interior space of the housing, a motor arranged in front of the fan to drive the fan, and a heater arranged in front of the motor. The motor is supported by the housing through a holder including an outer tubular portion, an inner tubular portion, and a support member arranged to join the outer and inner tubular portions to each other.

In the dryer having the above structure, the holder which supports the motor is fixed to an inner circumferential surface of the substantially tubular housing by screwing or the like. In the dryer having the above structure, it is difficult to make the motor completely still. Accordingly, while the dryer is in operation, the motor may vibrate, increasing noise caused by the motor. Further, when the holder which supports the motor is screwed to the inner circumferential surface of the housing, the number of obstacles in a wind channel increases. This makes it difficult to increase the air volume of the dryer.

SUMMARY OF THE INVENTION

A dryer according to a preferred embodiment of the present invention is arranged to send gas forward along a central axis extending in a front-rear direction, and includes a body portion; a first tubular portion arranged to at least partially cover an outer circumferential portion of the body portion; and a second tubular portion arranged axially behind the first tubular portion, and arranged to at least partially cover the outer circumferential portion of the body portion. The body portion includes an impeller including a plurality of blades arranged in a circumferential direction; a motor arranged to rotate the impeller about the central axis; a motor holding portion arranged to hold the motor; a plurality of connection portions arranged to extend radially outward from an outer circumference of the motor holding portion; a ring-shaped portion arranged to join radially outer end portions of the plurality of connection portions to one another; and an outer circumferential joining portion arranged on an outer circumference of the ring-shaped portion. The first tubular portion includes a first edge portion at an axial rear end thereof, and the second tubular portion includes a second edge portion at an axial front end thereof. The outer circumferential joining portion is held between the first and second edge portions.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, dryers according to preferred embodiments of the present invention will be described. It is assumed herein that a direction parallel to a central axis of a motor is referred to by the term "axial direction", "axial", or "axially", that directions perpendicular to the central axis of the motor are each referred to by the term "radial direction", "radial", or "radially", and that a direction along a circular arc centered on the central axis of the motor is referred to by the term "circumferential direction", "circumferential", or "circumferentially". It is also assumed herein that a downstream side and an upstream side (with respect to a wind) along the central axis of the motor are defined as a front side and a rear side, respectively. The shape of each member or portion and relative positions of different members or portions will be described based on the above assumption. It should be noted, however, that the above definition of a front-rear direction and the front and rear sides is not meant to restrict in any way the orientation of a dryer according to any preferred embodiment of the present invention when in use.

Figure 1:
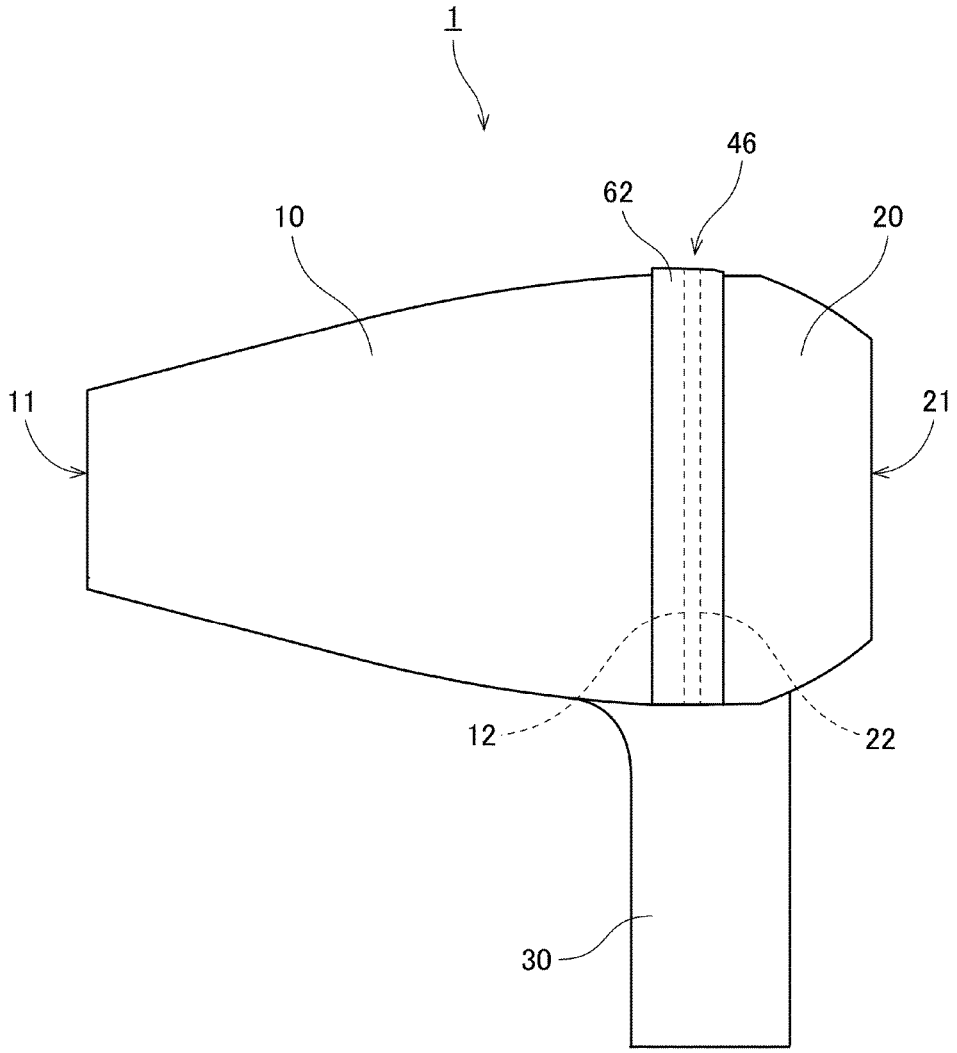
FIG. 1 is a side view of a dryer according to a preferred embodiment of the present invention.
Figure 2:
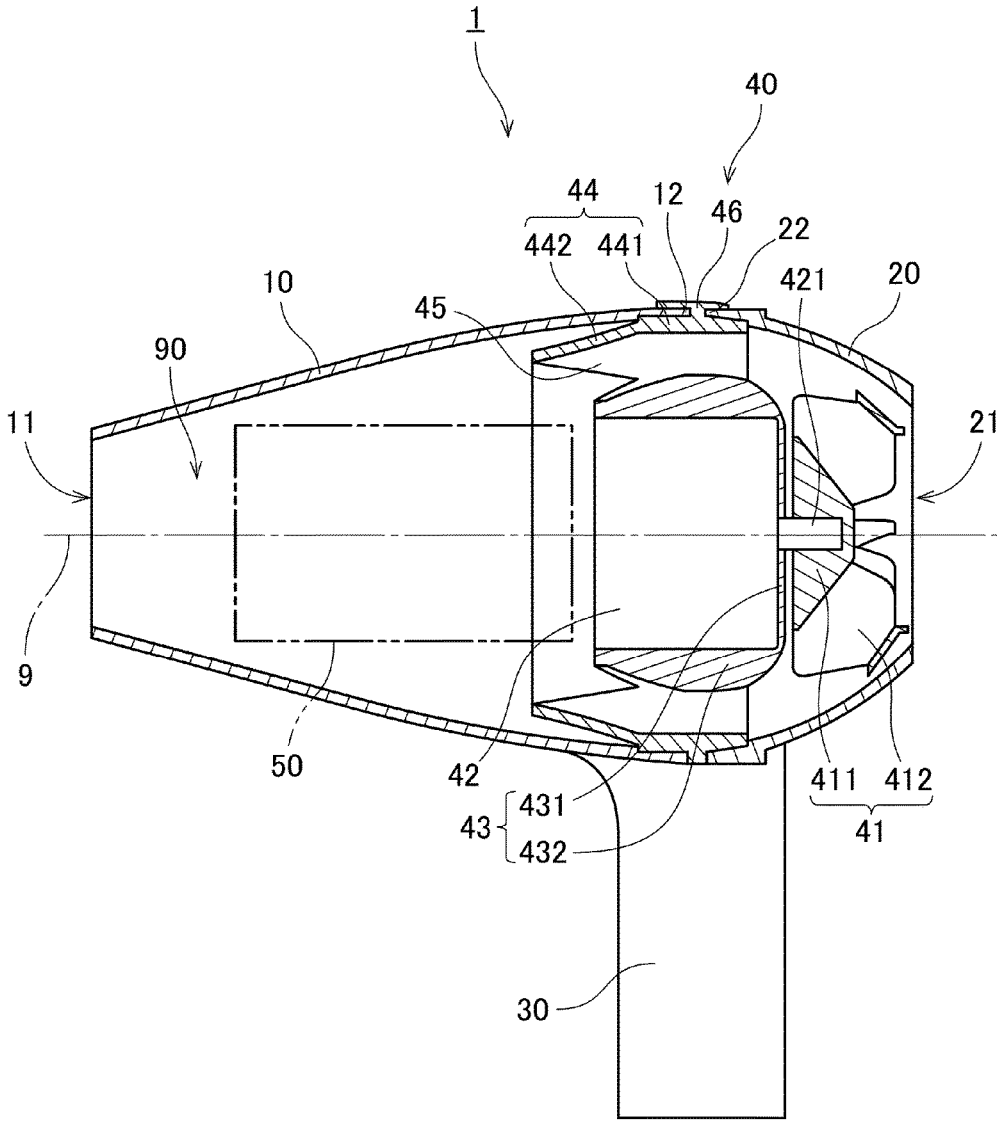
FIG. 2 is a vertical cross-sectional view of the dryer.

FIG. 1 is a side view of a dryer 1 according to a preferred embodiment of the present invention. FIG. 2 is a vertical cross-sectional view of the dryer 1. The drier 1 is an apparatus designed to send a hot wind forward in an axial direction by rotating an impeller 41 through power of a motor 42. The drier 1 is used, for example, as a household hair drier or a hair drier for professional use to dry hair. Note, however, that a structure similar to the structure of the dryer 1 may be applied to a dryer designed to dry or heat an object other than hair, such as an industrial drier.

Referring to FIGS. 1 and 2, the dryer 1 preferably includes a first tubular portion 10, a second tubular portion 20, a handle portion 30, a body portion 40, and a heater 50.

The first tubular portion 10 is arranged to extend in the axial direction around a central axis 9. A resin, for example, is used as a material of the first tubular portion 10. Both an inside diameter and an outside diameter of the first tubular portion 10 are arranged to gradually decrease in a forward direction. Therefore, the first tubular portion 10 has the greatest inside diameter and the greatest outside diameter at a rear opening thereof, and has the smallest inside diameter and the smallest outside diameter at a front opening thereof. The front opening of the first tubular portion 10 defines an air outlet 11 through which the hot wind is blown out. A portion of the first tubular portion 10 which includes a rear edge of the first tubular portion 10 is arranged to annularly cover a portion of an outer circumferential surface of a ring-shaped portion 44, which will be described below, of the body portion 40.

The second tubular portion 20 is a tubular member arranged to extend in the axial direction around the central axis 9, and arranged axially behind the first tubular portion 10. A resin, for example, is used as a material of the second tubular portion 20. Both an inside diameter and an outside diameter of the second tubular portion 20 are arranged to gradually increase in the forward direction. Therefore, the second tubular portion 20 has the smallest inside diameter and the smallest outside diameter at a rear opening thereof, and has the greatest inside diameter and the greatest outside diameter at a front opening thereof. The rear opening of the second tubular portion 20 defines an air inlet 21 through which gas is taken in. The air inlet 21 may be provided with a filter to prevent entrance of dust, and/or a guard to prevent entrance of a finger of a user, for example. A portion of the second tubular portion 20 which includes a front edge of the second tubular portion 20 is arranged to annularly cover a portion of the outer circumferential surface of the ring-shaped portion 44, which will be described below, of the body portion 40.

In this preferred embodiment, a cross section of each of the first and second tubular portions 10 and 20 taken along a plane perpendicular to the central axis 9 is substantially in the shape of a perfect circle. Note that the cross section of each of the first and second tubular portions 10 and 20 is not limited to any particular shape, and may be in another shape, such as, for example, an ellipse or a polygon.

The handle portion 30 is a member to be held by the user when the dryer 1 is used. The handle portion 30 is arranged to extend radially outward from an area including a boundary between the first and second tubular portions 10 and 20. A switch(es) (not shown) is provided in the handle portion 30 to allow the user to turn on and off the dryer 1 or adjust the power of the dryer 1. In the dryer 1, the first and second tubular portions 10 and 20 and the handle portion 30 are defined by separate members.

Figure 3:
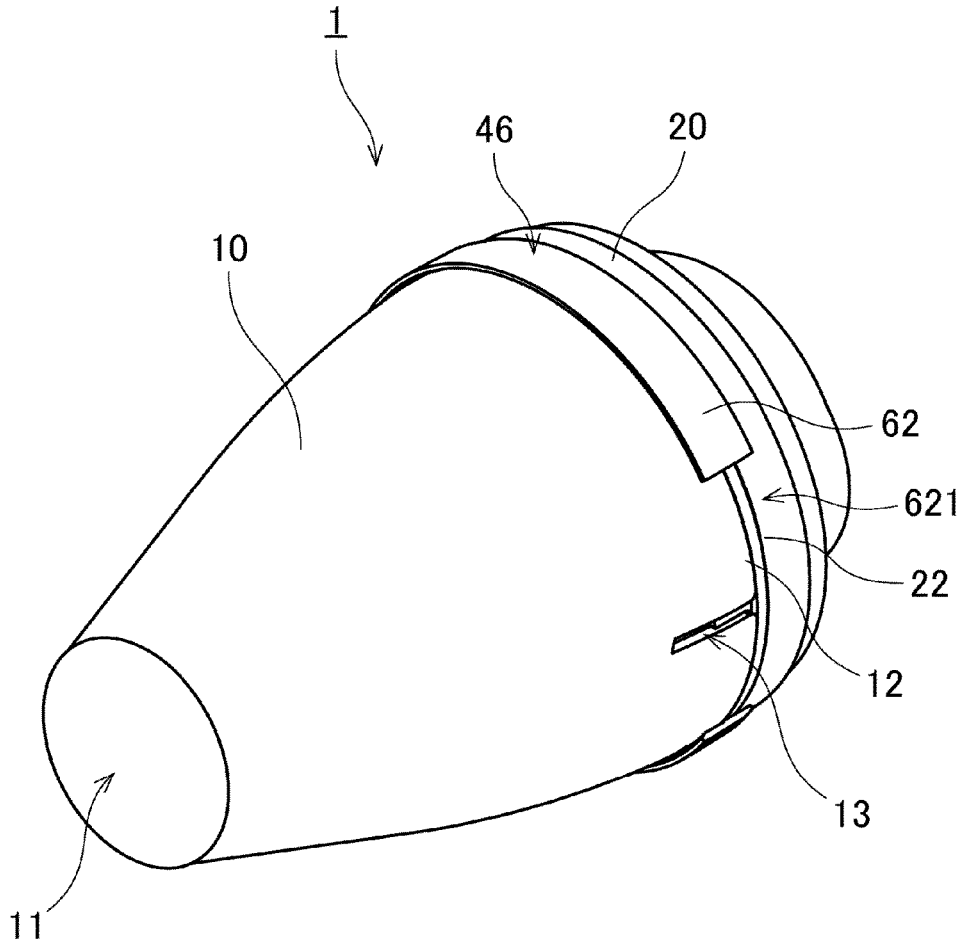
FIG. 3 is a perspective view of the dryer with a handle portion removed therefrom.

FIG. 3 is a perspective view of the dryer 1 with the handle portion 30 removed therefrom. Referring to FIG. 3, in the dryer 1, a fitting hole 13 is defined in a lower surface of the first tubular portion 10. A projection provided at an upper end portion of the handle portion 30 is fitted into the fitting hole 13 to fix the handle portion 30 to the first tubular portion 10. Note, however, that the handle portion 30 may be fixed to the first tubular portion 10 by another method, such as, for example, screwing. Also note that the handle portion 30 may alternatively be fixed to the second tubular portion 20.

The body portion 40 is arranged to intervene between the first and second tubular portions 10 and 20 to join the first and second tubular portions 10 and 20 to each other. The body portion 40 is a unit arranged to generate an air flow traveling axially forward inside of the first and second tubular portions 10 and 20. Referring to FIG. 2, the body portion 40 preferably includes the impeller 41, the motor 42, a motor holding portion 43, the ring-shaped portion 44, a plurality of connection portions 45, and an outer circumferential joining portion 46.

The impeller 41 is a member arranged to generate the air flow by rotating about the central axis 9. The impeller 41 is arranged radially inside of the second tubular portion 20. Referring to FIG. 2, the impeller 41 includes a cup portion 411 arranged in a center thereof, and a plurality of blades 412 arranged to extend radially outward from the cup portion 411. The cup portion 411 is fixed to a shaft 421 of the motor 42, which will be described below. The blades 412 are arranged in a circumferential direction radially outside of the cup portion 411. Once the impeller 41 starts rotating, the gas is accelerated by the blades 412. As a result, an air flow traveling axially forward and radially outward is generated.

The cup portion 411 and the blades 412 are defined as a single monolithic member by an injection molding process using a resin, for example. Note, however, that the impeller 41 may alternatively be defined by a plurality of separate members. For example, the cup portion 411 and the blades 412 may be defined by separate members. Also note that a material of the impeller 41 may be a material other than resins.

The motor 42 is a power source to supply power for rotation to the impeller 41. In the dryer 1, the motor 42 is arranged axially in front of the impeller 41. Note, however, that the motor 42 may alternatively be arranged axially behind the impeller 41. The motor 42 includes the shaft 421, which is arranged to extend along the central axis 9. Once the motor 42 is driven, a torque centered on the central axis 9 is produced by a rotating magnetic field between coils and a magnet arranged inside the motor 42. As a result, the shaft 421 of the motor 42 is caused to rotate about the central axis 9.

The motor 42 is, for example, a brushless DC motor. The brushless DC motor has a longer life than a comparable brushed motor because the brushless DC motor is free from a deterioration in performance caused by a wear of a brush. It is easier to change the speed of the brushless DC motor than the speed of an AC motor, and it is also easier to reduce the power consumption of the brushless DC motor than the power consumption of the AC motor. Note that, instead of the brushless DC motor, a motor of another type, such as, for example, a brushed motor or an AC motor, may be used as the motor 42.

The motor holding portion 43 is a member arranged to hold the motor 42 axially in front of the impeller 41. The motor holding portion 43 includes a plate-shaped rear wall portion 431 and an annular side wall portion 432. The rear wall portion 431 is arranged to extend perpendicularly to the central axis 9. The side wall portion 432 is arranged to surround the motor 42. A rear end surface of the motor 42 is arranged to be in contact with a front surface of the rear wall portion 431. An outer circumferential surface of the motor 42 is arranged to be at least in partial contact with an inner circumferential surface of the side wall portion 432. The motor 42 is thus axially and radially positioned. The air flow generated by the impeller 41 passes through a space radially outside of the motor holding portion 43.

An axial front end portion of the side wall portion 432 is arranged radially inside of the first tubular portion 10. An axial rear end portion of the side wall portion 432 and the rear wall portion 431 are arranged radially inside of the second tubular portion 20. An outer circumferential surface of the side wall portion 432 is arranged to once increase in diameter and then decrease in diameter as it extends axially forward from an axial rear end thereof. That is, the outer circumferential surface of the side wall portion 432 is curved to extend along opposed portions of inner circumferential surfaces of the first and second tubular portions 10 and 20. This increases efficiency with which the air flow generated by the impeller 41 is sent axially forward around the motor holding portion 43.

The ring-shaped portion 44 is arranged radially outward of the motor holding portion 43, and is arranged to annularly surround the motor holding portion 43. The air flow generated by the impeller 41 passes through a space radially inside of the ring-shaped portion 44. That is, the dryer 1 preferably includes the first tubular portion 10, the second tubular portion 20, and a wind channel 90. The wind channel 90 is arranged to extend continuously from the air inlet 21 to the air outlet 11, and includes a portion located radially inside of the ring-shaped portion 44 and radially outside of the motor holding portion 43.

Referring to FIG. 2, the ring-shaped portion 44 preferably includes a cylindrical ring portion 441 and an inclined ring portion 442. The cylindrical ring portion 441 is cylindrical, and is arranged to extend substantially parallel to the central axis 9. An outer circumferential surface of the cylindrical ring portion 441 is arranged to be in contact with both the first and second tubular portions 10 and 20. An axial front end portion of the cylindrical ring portion 441 is arranged radially inside of the first tubular portion 10. An axial rear end portion of the cylindrical ring portion 441 is arranged radially inside of the second tubular portion 20.

The inclined ring portion 442 is arranged to extend axially forward and radially inward from the axial front end portion of the cylindrical ring portion 441 to assume a conical shape or substantially conical shape. That is, both an inside diameter and an outside diameter of the inclined ring portion 442 are arranged to gradually decrease in the forward direction. The air flow passing through the space radially inside of the ring-shaped portion 44 is guided radially inward by the inclined ring portion 442. This allows the air flow to be efficiently sent toward the heater 50, which will be described below.

In the dryer 1, the first tubular portion 10 is arranged to be out of contact with the inclined ring portion 442. A gap is defined between the inner circumferential surface of the first tubular portion 10 and an outer circumferential surface of the inclined ring portion 442. This makes it possible to design each of the first tubular portion 10 and the inclined ring portion 442 to have an optimum shape. For example, it is possible to improve a flow control effect produced by the inclined ring portion 442 on the air flow without spoiling the external appearance of the first tubular portion 10.

In the dryer 1, the ring-shaped portion 44 is arranged to have an axial dimension greater than an axial dimension of a holding cover portion 62, which will be described below. Arranging the ring-shaped portion 44 to have a large axial dimension as described above further improves the flow control effect produced by the ring-shaped portion 44 on the air flow.

The connection portions 45 are arranged to extend radially to join the motor holding portion 43 and the ring-shaped portion 44 to each other. Each connection portion 45 is arranged to extend radially outward from an outer circumferential surface of the motor holding portion 43 to be joined to an inner circumferential surface of the ring-shaped portion 44. In other words, radially inner end portions of the connection portions 45 are joined to one another by the motor holding portion 43. Radially outer end portions of the connection portions 45 are joined to one another by the ring-shaped portion 44. The connection portions 45 are arranged at substantially regular intervals in the circumferential direction. An air flow generated by the impeller 41 passes between adjacent ones of the connection portions 45 toward the heater 50. The position of the motor holding portion 43 relative to the ring-shaped portion 44 is determined by the connection portions 45. Note that each connection portion 45 may be a rib used merely for supporting, or may have a function of guiding the air flow. That is, each connection portion 45 may be a stationary vane having a flow control function.

The outer circumferential joining portion 46 is arranged to join the first and second tubular portions 10 and 20 to each other to fix the position of the body portion 40 relative to the first and second tubular portions 10 and 20. The outer circumferential joining portion 46 is arranged along the outer circumferential surface of the ring-shaped portion 44. The outer circumferential joining portion 46 will be described in detail below.

The heater 50 is arranged inside of the first tubular portion 10 and axially in front of the motor 42. The heater 50 includes, for example, a heating wire, such as a nichrome wire, which generates heat when energized, and a support plate arranged to support the heating wire. In FIG. 2, the heater 50 is represented by a chain double-dashed line although the details of the heater 50 are not illustrated. An axial rear end of the heater 50 is arranged axially rearward of an axial front end of the ring-shaped portion 44. Thus, the heater 50 is disposed in the dryer 1 with an efficient use of a space inside of the ring-shaped portion 44.

Once a power switch of the drier 1 is turned on, electric currents are supplied to the motor 42 and the heating wire of the heater 50. The motor 42 is thus driven to cause the shaft 421 and the impeller 41 fixed to the shaft 421 to rotate about the central axis 9. As a result, gas is accelerated by the blades 412, and an air flow traveling axially forward is generated in the wind channel 90. The air flow is heated by the heater 50 after passing the ring-shaped portion 44. The heated air flow is blown out axially forward through the air outlet 11.

Next, the structure of the outer circumferential joining portion 46 will now be described in detail below.

Figure 4:
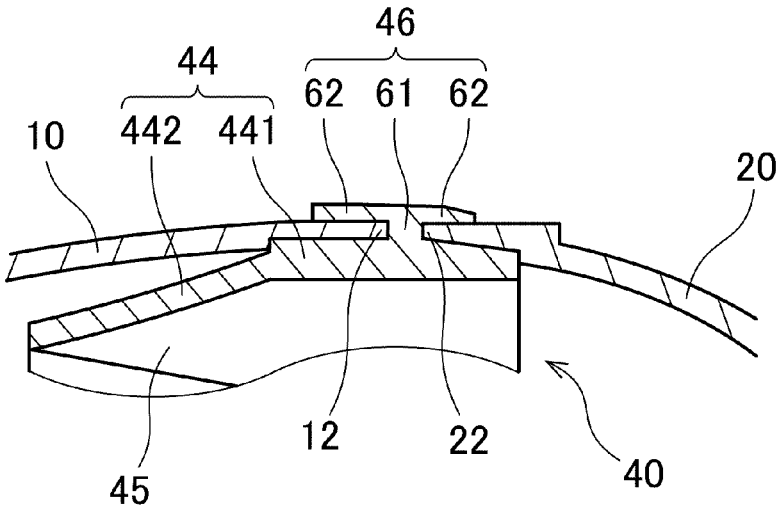
FIG. 4 is a partial vertical cross-sectional view of the dryer, illustrating an outer circumferential joining portion and its vicinity.

FIG. 4 is a partial vertical cross-sectional view of the dryer 1, illustrating the outer circumferential joining portion 46 and its vicinity. Referring to FIG. 4, the outer circumferential joining portion 46 includes a spacer portion 61 and the holding cover portion 62. The spacer portion 61 is arranged to project radially outward from the outer circumferential surface of the cylindrical ring portion 441. The spacer portion 61 may have any desirable shape, and may be, for example, annular or in the shape of a circular arc. The holding cover portion 62 is arranged to extend both axially forward and axially rearward from a radially outer end portion of the spacer portion 61.

An axial rear edge portion of the first tubular portion 10 will be hereinafter referred to as a first edge portion 12. An axial front edge portion of the second tubular portion 20 will be hereinafter referred to as a second edge portion 22. Referring to FIG. 4, the spacer portion 61 of the outer circumferential joining portion 46 is held axially between the first and second edge portions 12 and 22. An axial front surface of the spacer portion 61 is arranged to be in contact with the first edge portion 12. An axial rear surface of the spacer portion 61 is arranged to be in contact with the second edge portion 22. The axial position of the body portion 40 relative to the first and second tubular portions 10 and 20 is thus fixed.

The first and second edge portions 12 and 22 are held between the cylindrical ring portion 441 of the ring-shaped portion 44 and the holding cover portion 62 of the outer circumferential joining portion 46. Each of the first and second edge portions 12 and 22 is arranged to be in contact with at least one of the cylindrical ring portion 441 and the holding cover portion 62. The radial position of the body portion 40 relative to the first and second edge portions 12 and 22 is thus fixed. As a result, the body portion 40 is positioned such that the body portion 40 is substantially coaxial with the first and second tubular portions 10 and 20.

The first and second tubular portions 10 and 20 include screw holes (not shown). When the dryer 1 is assembled, screws are axially inserted through the screw holes to fix the first tubular portion 10 to the second tubular portion 20. The screws are not inserted through the body portion 40. However, the body portion 40 is fixed by being held between the first and second tubular portions 10 and 20 as mentioned above.

In the dryer 1, the body portion 40 holding the motor 42 is held axially between the first and second tubular portions 10 and 20 as described above. This allows the motor 42 to be securely held, making it possible to reduce the number of parts used to hold the motor 42. The above fixing structure is unlikely to cause a displacement of the motor 42. This reduces vibrations and noise which occur while the dryer 1 is in operation. The above fixing structure does not require screws or the like to be used inside of the first tubular portion 10 or the second tubular portion 20 to fix the motor 42. This reduces the number of obstacles in the wind channel 90, increasing efficiency with which gas flows through the wind channel 90.

In the dryer 1, the holding cover portion 62 is arranged to extend both axially forward and axially rearward from the radially outer end portion of the spacer portion 61. Accordingly, outer circumferential surfaces of both the first and second edge portions 12 and 22 are covered with the holding cover portion 62. Thus, the holding cover portion 62 restrains both the first and second edge portions 12 and 22 from being displaced radially outward. Accordingly, the body portion 40 is more securely fixed with respect to the first and second tubular portions 10 and 20.

In the dryer 1, each of the first edge portion 12 of the first tubular portion 10 and the second edge portion 22 of the second tubular portion 20 is arranged to be substantially parallel to the central axis 9. The spacer portion 61 of the outer circumferential joining portion 46 is held between the first and second edge portions 12 and 22. Accordingly, when the first and second tubular portions 10 and 20 are axially securely fixed to each other through the screws, radial component forces are unlikely to be exerted on the first and second tubular portions 10 and 20. Thus, the likelihood of a deformation of each of the first and second tubular portions 10 and 20 is minimized, and the body portion 40 can be securely fixed to the first and second tubular portions 10 and 20.

In the dryer 1, an outside diameter of the first edge portion 12 of the first tubular portion 10 is greater than an outside diameter of any other portion of the first tubular portion 10. An outside diameter of the second edge portion 22 of the second tubular portion 20 is greater than an outside diameter of any other portion of the second tubular portion 20. In this preferred embodiment, an inside diameter of the first edge portion 12 of the first tubular portion 10 is greater than an inside diameter of any other portion of the first tubular portion 10. An inside diameter of the second edge portion 22 of the second tubular portion 20 is greater than an inside diameter of any other portion of the second tubular portion 20. In the dryer 1, the spacer portion 61 is held and fixed between a portion of the first tubular portion 10 which has the greatest outside diameter and a portion of the second tubular portion 20 which has the greatest outside diameter. In other words, the spacer portion 61 is held and fixed between a portion of the first tubular portion 10 which has the greatest inside diameter and a portion of the second tubular portion 20 which has the greatest inside diameter. This leads to an increased width of a space in which the motor 42 is arranged and an increased width of the wind channel 90 radially inside of the first and second edge portions 12 and 22.

The motor holding portion 43, the ring-shaped portion 44, the connection portions 45, and the outer circumferential joining portion 46 can be defined as a single continuous monolithic member by an injection molding process using a resin, for example. Note, however, that any of these portions may be defined by a member separate from the other portions. At least a material of the outer circumferential joining portion 46 is preferably arranged to be more elastic than the material of the first tubular portion 10 and the material of the second tubular portion 20. This allows the outer circumferential joining portion 46 to be in closer contact with each of the first edge portion 12 of the first tubular portion 10 and the second edge portion 22 of the second tubular portion 20. This contributes to further reducing vibration of the body portion 40 caused by driving of the motor 42.

Referring to FIG. 3, the holding cover portion 62 of the dryer 1 is not annular but in the shape of a circular arc. Accordingly, one circumferential portion of each of the first and second edge portions 12 and 22 is not covered with the holding cover portion 62. The upper end portion of the handle portion 30 is arranged to be in contact with the uncovered portion of each of the first and second edge portions 12 and 22. In other words, the holding cover portion 62 includes a handle attachment portion 621. The handle attachment portion 621 is a non-existent portion which makes a portion of the outer circumferential surface of each of the first and second edge portions 12 and 22 uncovered. The remaining portion of each of the first and second edge portions 12 and 22 is covered with the holding cover portion 62, and is thus securely fixed. This reduces the likelihood that any of the first and second edge portions 12 and 22 will be deformed by attachment of the handle portion 30.

While preferred embodiments of the present invention have been described above, it will be understood that the present invention is not limited to the above-described preferred embodiments.

Figure 5:
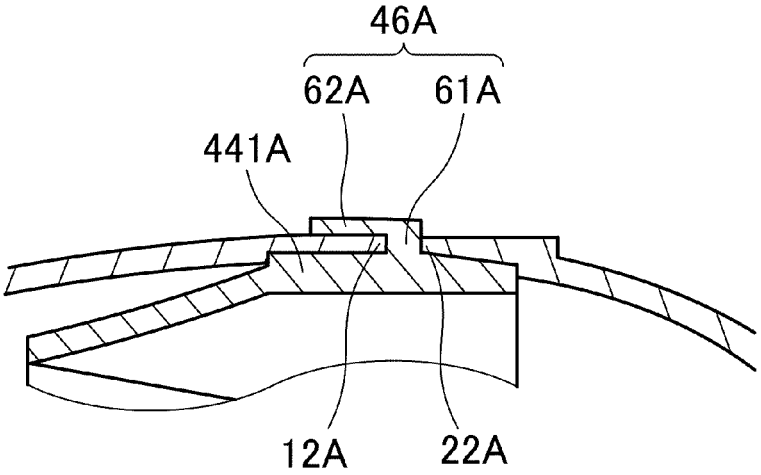
FIG. 5 is a partial vertical cross-sectional view of a dryer according to a modification of the above preferred embodiment of the present invention, illustrating an outer circumferential joining portion and its vicinity.

FIG. 5 is a partial vertical cross-sectional view of a dryer according to a modification of the above-described preferred embodiment, illustrating an outer circumferential joining portion 46A and its vicinity. In FIG. 5, a holding cover portion 62A is arranged to extend only axially forward from a radially outer end portion of a spacer portion 61A. Accordingly, of an outer circumferential surface of a first edge portion 12A and an outer circumferential surface of a second edge portion 22A, only the outer circumferential surface of the first edge portion 12A is covered with the holding cover portion 62A. Of the first and second edge portions 12A and 22A, only the first edge portion 12A is held radially between a cylindrical ring portion 441A and the holding cover portion 62A.

As described above, the holding cover portion may be arranged to cover the outer circumferential surface of only one of the first and second edge portions. Only one of the first and second edge portions may be held radially between the cylindrical ring portion and the holding cover portion.

Figure 6:
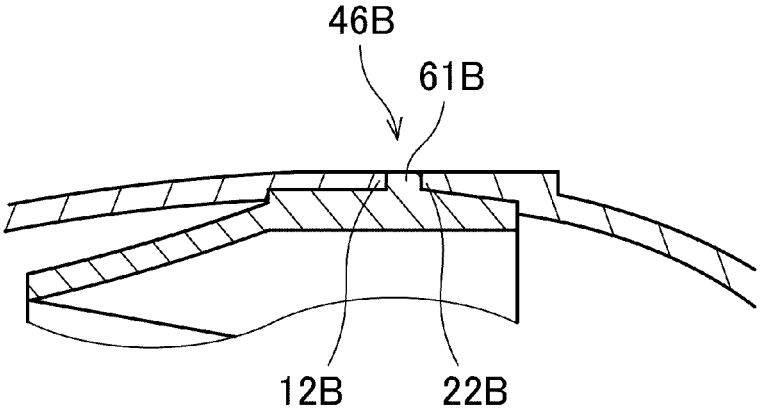
FIG. 6 is a partial vertical cross-sectional view of a dryer according to a modification of the above preferred embodiment of the present invention, illustrating an outer circumferential joining portion and its vicinity.

FIG. 6 is a partial vertical cross-sectional view of a dryer according to another modification of the above-described preferred embodiment, illustrating an outer circumferential joining portion 46B and its vicinity. In FIG. 6, the outer circumferential joining portion 46B includes only a spacer portion 61B. As illustrated in FIG. 6, the holding cover portion may be omitted if both a first edge portion 12B and a second edge portion 22B are unlikely to deform radially outward.

Figure 7:
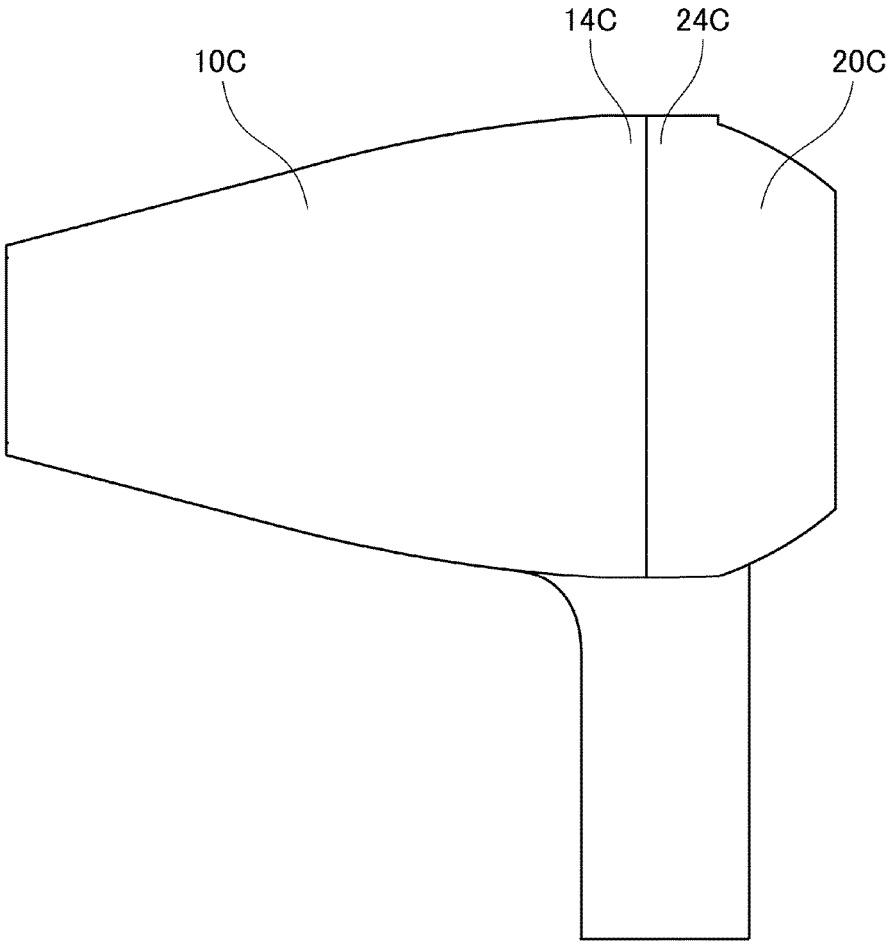
FIG. 7 is a side view of a dryer according to a modification of the above preferred embodiment of the present invention.
Figure 8:
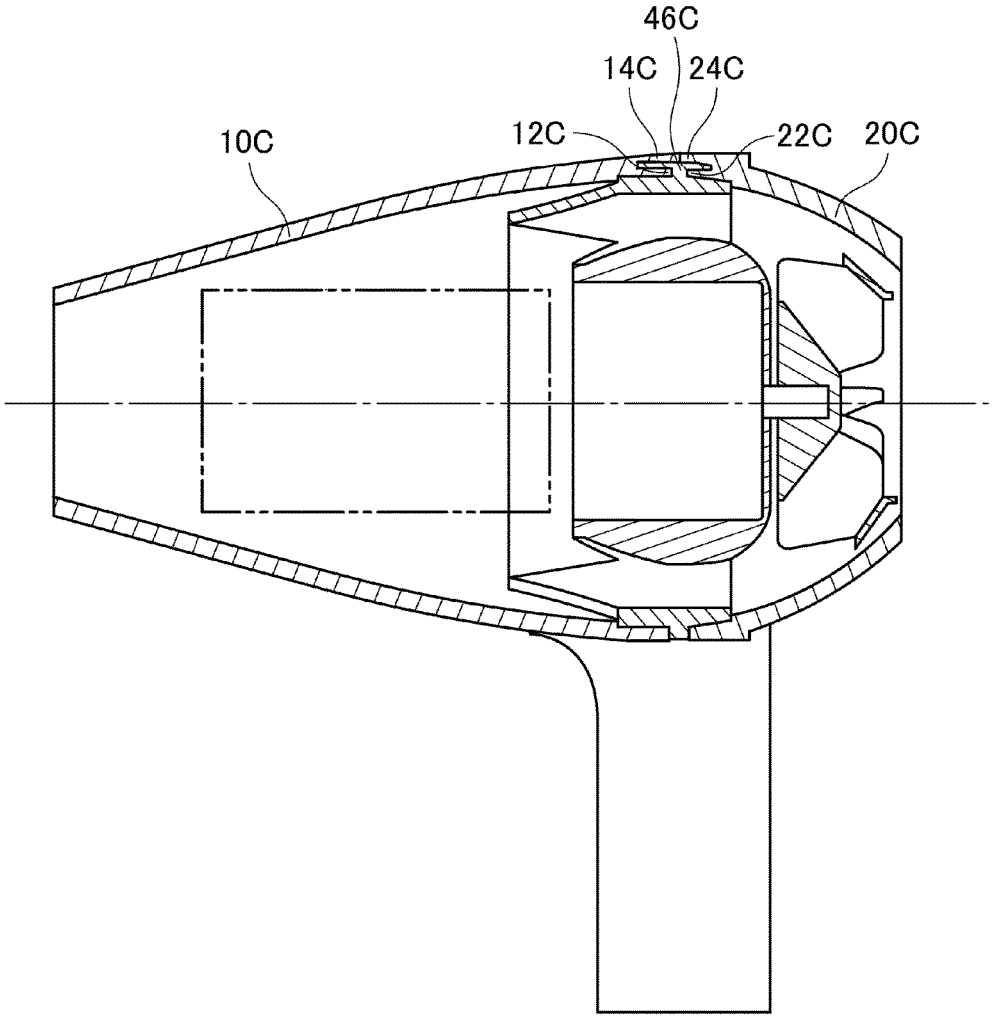
FIG. 8 is a vertical cross-sectional view of the dryer according to a modification of the above preferred embodiment of the present invention.

FIG. 7 is a side view of a dryer 1C according to yet another modification of the above-described preferred embodiment. FIG. 8 is a vertical cross-sectional view of the dryer 1C. In FIGS. 7 and 8, a first tubular portion 10C includes a first outer cover portion 14C. The first outer cover portion 14C is arranged radially outward of a first edge portion 12C. A second tubular portion 20C includes a second outer cover portion 24C. The second outer cover portion 24C is arranged radially outward of a second edge portion 22C. The first and second outer cover portions 14C and 24C are arranged to cover an outer circumferential surface of an outer circumferential joining portion 46C.

As described above, at least one of the first and second tubular portions may include an outer cover portion arranged to at least partially cover the outer circumferential surface of the outer circumferential joining portion. This allows the body portion to be more securely fixed to the first and second tubular portions. Moreover, a joint by the outer circumferential joining portion can thus be hidden from view from the outside.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A dryer arranged to send gas forward along a central axis extending in a front-rear direction, the dryer comprising:

a body portion;

a first tubular portion arranged to at least partially cover an outer circumferential portion of the body portion; and a second tubular portion arranged axially behind the first tubular portion, and arranged to at least partially cover the outer circumferential portion of the body portion; wherein the body portion includes:

an impeller including a plurality of blades arranged in a circumferential direction;

a motor arranged to rotate the impeller about the central axis;

a motor holding portion arranged to hold the motor;

a plurality of connection portions arranged to extend radially outward from an outer circumference of the motor holding portion;

a ring-shaped portion arranged to join radially outer end portions of the plurality of connection portions to one another; and an outer circumferential joining portion arranged on an outer circumference of the ring-shaped portion;

the first tubular portion includes a first edge portion at an axial rear end thereof, and the second tubular portion includes a second edge portion at an axial front end thereof; and the outer circumferential joining portion is held between the first and second edge portions.

2. The dryer according to claim 1, wherein the outer circumferential joining portion includes:

a spacer portion held between the first and second edge portions; and a holding cover portion arranged to cover at least a portion of an outer circumferential surface of at least one of the first and second edge portions.

3. The dryer according to claim 2, wherein the holding cover portion is arranged to cover at least a portion of the outer circumferential surface of each of the first and second edge portions.

4. The dryer according to claim 2, wherein at least one of the first and second edge portions is radially held between the ring-shaped portion and the holding cover portion.

5. The dryer according to claim 2, wherein the ring-shaped portion is arranged to have an axial dimension greater than an axial dimension of the holding cover portion.

6. The dryer according to claim 2, wherein the holding cover portion includes a handle attachment portion arranged to make a portion of the outer circumferential surface of each of the first and second edge portions uncovered.

7. The dryer according to claim 1, wherein at least one of the first and second tubular portions further includes an outer cover portion arranged radially outward of the first and second edge portions; and the outer cover portion is arranged to at least partially cover an outer circumferential surface of the outer circumferential joining portion.

8. The dryer according to claim 1, wherein each of the first and second edge portions is arranged to be substantially parallel to the central axis.

9. The dryer according to claim 1, wherein the first edge portion is arranged to have a diameter greater than that of any other portion of the first tubular portion; and the second edge portion is arranged to have a diameter greater than that of any other portion of the second tubular portion.

10. The dryer according to claim 1, wherein an outer circumferential surface of the motor holding portion is curved to extend along opposed portions of inner circumferential surfaces of the first and second tubular portions.

11. The dryer according to claim 1, further comprising a heater arranged inside of the first tubular portion, wherein an axial rear end of the heater is arranged axially rearward of an axial front end of the ring-shaped portion.

12. The dryer according to claim 1, wherein a gap is defined between an inner circumferential surface of the first tubular portion and an outer circumferential surface of the ring-shaped portion.

13. The dryer according to claim 1, wherein a material of the outer circumferential joining portion is more elastic than a material of the first tubular portion and a material of the second tubular portion.

* * * * *